US007748820B2

(12) United States Patent
Shindo

(10) Patent No.: US 7,748,820 B2
(45) Date of Patent: Jul. 6, 2010

(54) IMAGE RECORDING APPARATUS

(75) Inventor: Tatsuya Shindo, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 751 days.

(21) Appl. No.: 11/533,682

(22) Filed: Sep. 20, 2006

(65) Prior Publication Data

US 2007/0070115 A1 Mar. 29, 2007

(30) Foreign Application Priority Data

Sep. 26, 2005 (JP) ..... 2005-277297

(51) Int. Cl.
*B41J 2/165* (2006.01)

(52) U.S. Cl. ..... 347/29; 347/31; 347/32

(58) Field of Classification Search ..... 347/29–33
See application file for complete search history.

(56) References Cited

U.S. PATENT DOCUMENTS

| | | | | |
|---|---|---|---|---|
| 5,805,181 | A | 9/1998 | Tamaka et al. | |
| 5,896,143 | A * | 4/1999 | Matsui et al. | 347/24 |
| 6,010,203 | A * | 1/2000 | Muraki | 347/30 |
| 6,540,322 | B2 * | 4/2003 | Usui et al. | 347/29 |
| 6,729,717 | B2 | 5/2004 | Ito et al. | |
| 7,334,862 | B2 * | 2/2008 | Kachi | 347/22 |
| 2004/0165028 | A1 | 8/2004 | Ito et al. | |
| 2006/0001715 | A1 | 1/2006 | Umeda et al. | |

FOREIGN PATENT DOCUMENTS

| | | |
|---|---|---|
| JP | H6115088 | 4/1994 |
| JP | H8244249 | 9/1996 |
| JP | H9300656 | 11/1997 |
| JP | 2001219560 | 8/2001 |
| JP | 200267312 | 3/2002 |
| JP | 2004255861 | 9/2004 |

* cited by examiner

*Primary Examiner*—Shih-Wen Hsieh
(74) *Attorney, Agent, or Firm*—Baker Botts L.L.P.

(57) ABSTRACT

An image recording apparatus including: an ink-jet head having a plurality of nozzles which are open in a surface thereof so as to provide a nozzle opening surface and through which ink is ejected; and a cap which is operable to cover the nozzle opening surface of the ink-jet head so as to surround the plurality of nozzles and which includes (a) a peripheral portion that comes into close contact with the nozzle opening surface at an end thereof when the cap covers the nozzle opening surface and (b) an outlet formed at a part of the peripheral portion, the part being located at a lower position when the image recording apparatus is kept in a posture for transportation thereof.

12 Claims, 14 Drawing Sheets

IMAGE RECORDING APPARATUS

This application is based on Japanese Patent Application No. 2005-277297 filed on Sep. 26, 2005, the contents of which are incorporated hereinto by reference.

BACKGROUND OF THE INVENTION

1. Field of the Invention

The present invention relates to an image recording apparatus which includes an ink-jet head and which is transported with the ink-jet head accommodating ink or a storage solution therein.

2. Discussion of Related Art

As an image recording apparatus such as an ink-jet printer which includes an ink-jet head that performs recording by ejecting ink to a recording medium, there is known one equipped with a purge device for discharging air-bubbles, poor-quality ink and the like accumulated in the ink-jet head. For instance, an image recording apparatus disclosed in JP-A-2004-255861 includes a suction cap which is connected to a suction pump. The suction cap covers a nozzle opening surface of the ink-jet head and sucks ink from the nozzles at a predetermined timing during operation of the image recording apparatus, for thereby maintaining and restoring the ink ejection performance of the ink-jet head. Further, the image recording apparatus may be arranged such that a suction cap covers the nozzle opening surface while the ink-jet head is in a non-operating state, whereby the suction cap serves also as a drying-preventive cap for preventing drying of ink to be ejected through the nozzles.

The image recording apparatus may include only the drying-preventive cap which is not connected to the suction pump or may include the drying-preventive cap which is disposed together with the suction cap.

In general, the image recording apparatus equipped with the ink-jet head is packed with ink or a storage solution (which does not contain dyes, pigments and the like) stored in an inside of the ink-jet head upon shipment thereof from factories, for permitting smooth ink introduction when the apparatus is initially used by users. The image recording apparatus shipped from factories, however, may suffer from expansion of the air existing in the inside of the ink-jet head due to changes in the temperature or the atmospheric pressure in the environment during transportation of the apparatus (such as ground transportation, waterborne transportation, or air freighting). In this instance, the ink or the storage solution stored in the inside of the ink-jet head may leak out of the ink-jet head to an exterior.

In view of the above, the image recording apparatus is arranged such that the drying-preventive cap or the suction cap described above covers the nozzle opening surface of the ink-jet head during the transportation of the image recording apparatus, thereby preventing leakage of the ink or the storage solution accommodated in the ink-jet head and accordingly preventing contamination of the vicinity of the ink-jet head with the ink or the storage solution.

SUMMARY OF THE INVENTION

The aforementioned drying-preventive cap, however, may cause the following problem: The drying-preventive cap does not have any outlet through which the ink accumulated in an inside of the cap is discharged. Accordingly, when a large amount of ink is accumulated in the inside of the cap, the ink may overflow the cap, thereby contaminating the vicinity of the ink-jet head.

The aforementioned suction cap may cause the following problem: Although the suction cap is formed with an outlet through which the ink is discharged toward the suction pump, the outlet is not necessarily located at a lower position in the vertical direction during the transportation of the image recording apparatus. In this instance, the ink accumulated in the inside of the cap is not smoothly discharged. Accordingly, there may be a risk of causing overflow of the ink out of the cap and contaminating the vicinity of the ink-jet head, as in the drying-preventive cap described above.

When the inside of the ink-jet head becomes a negative pressure due to changes m the atmospheric pressure during transportation, the ink leaked out of the head may be drawn back to the inside of the head. Where the ink-jet head is designed to perform color printing by ejecting inks of a plurality of colors, the inks of the plurality of colors mix with each other within the cap, so that the mixed ink is drawn back to the inside of the ink-jet head. As a result, the contamination by the mixed ink spreads in the inside of the head, causing a problem that the ink-jet head cannot eject the inks of proper colors when the users initiate printing operation.

It is therefore an object of the invention to provide an image recording apparatus which can prevent, with high reliability, contamination of the vicinity of the ink-jet head with the ink that has leaked out of the ink-jet head during transportation of the apparatus.

The above-indicated object of the present invention may be achieved according to a principle of the invention, which provides an image recording apparatus comprising: an ink-jet head having a plurality of nozzles which are open in a surface thereof so as to provide a nozzle opening surface and through which ink is ejected: and a cap which is operable to cover the nozzle opening surface of the ink-jet head so as to surround the plurality of nozzles and which includes (a) a peripheral portion that comes into close contact with the nozzle opening surface at an end thereof when the cap covers the nozzle opening surface and (b) an outlet formed at a part of the peripheral portion, the part being located at a lower position when the image recording apparatus is kept in a posture for transportation thereof.

In the image recording apparatus constructed as described above, the nozzle opening surface of the ink-jet head is covered by the cap and the cap has an outlet formed therethrough at a part thereof that is to be located at a lower position when the image recording apparatus is kept in a posture for transportation thereof. Accordingly, even if the ink (or the storage solution) stored in the ink-jet head leaks through the nozzles into the cap as a result of expansion of the air due to changes in the temperature or the atmospheric pressure, the leaked ink is readily discharged through the outlet of the cap. Namely, even where a large amount of ink leaks through the nozzles, the leaked ink does not overflow the cap, so that the vicinity of the ink-jet head is prevented from being contaminated with the ink.

Where the ink-jet head is designed to perform color printing by ejecting inks of a plurality of colors, the inks of the plurality of colors mix with each other within the cap. However, the mixed ink is discharged from the outlet of the cap and does not remain within the cap. Therefore, even when the atmospheric pressure or the like changes, there is no risk that the mixed ink is drawn back into the ink-jet head and accordingly contaminates the inside of the ink-jet head.

BRIEF DESCRIPTION OF THE DRAWINGS

The above and other objects, features, advantages and technical and industrial significance of the present invention will be better understood by reading the following detailed description of presently preferred embodiments of the invention, when considered in connection with the accompanying drawings, in which.

DETAILED DESCRIPTION OF THE PREFERRED EMBODIMENTS

There will be described in detail preferred embodiments of the present invention by reference to the accompanying drawings.

Figure 1:
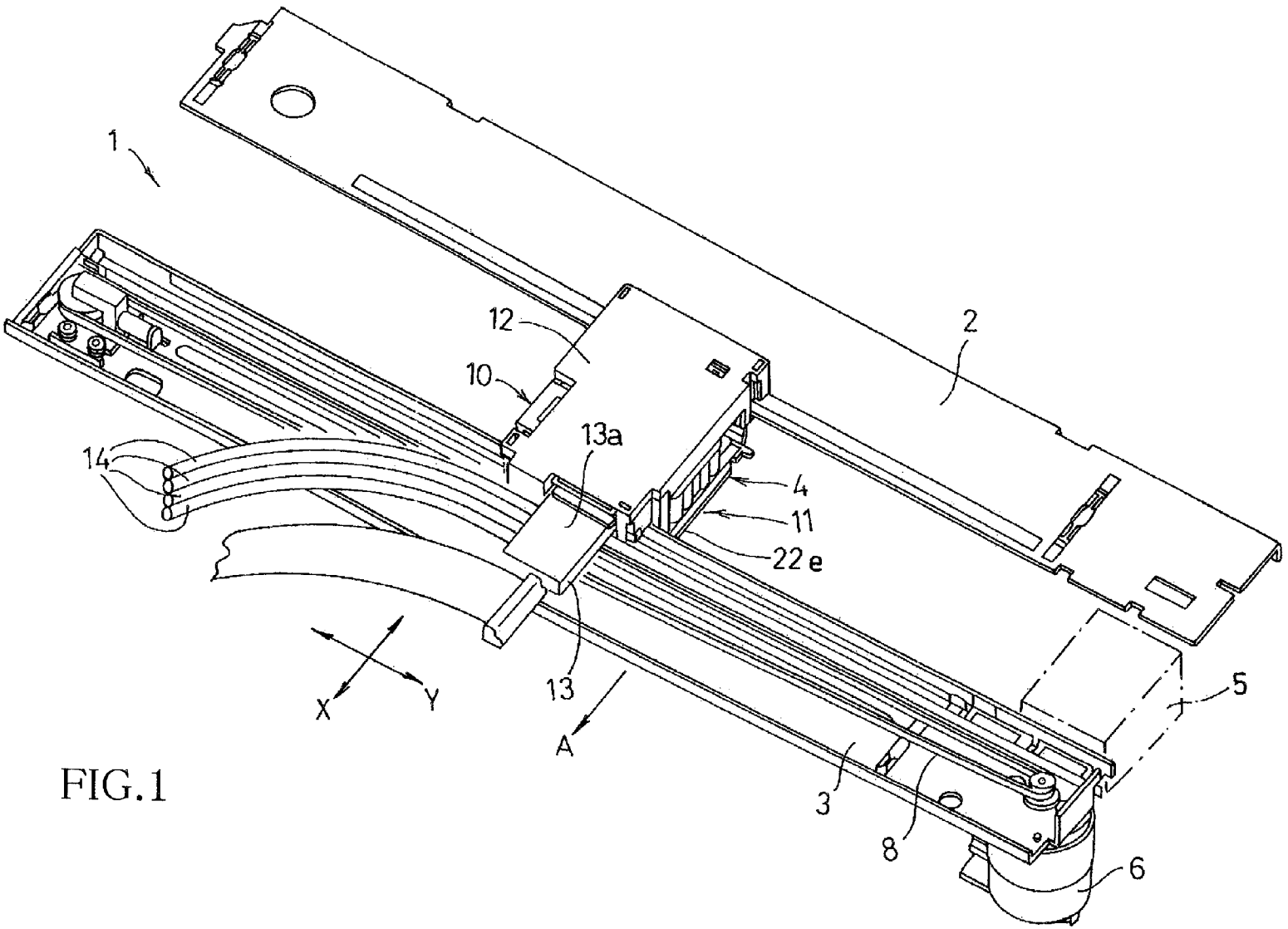
FIG. 1 is a perspective view showing principal parts of an image recording apparatus to which the principle of the present invention is applied.

Referring to FIGS. 1-7, there will be explained an image recording apparatus constructed according to a first embodiment of the present invention. As shown in FIG. 1, the present image recording apparatus has a recording portion 1 provided in its main body 100 (FIG. 7A). Within the recording portion 1, there is disposed an ink-jet head unit 4 (hereinafter referred to as "recording head unit") from which ink is ejected to a sheet of paper as a recording medium for printing operation. The image recording apparatus is a multi-function device (MFD) having a printing function, a copying function, a scanning function and a facsimile function. The recording head unit 4 is mounted on an ink-jet printer that performs the printing function.

The recording portion 1 includes: the recording head unit 4 that constitutes a carriage which is slidably mounted on two elongate plate-like guide rails 2, 3 extending in a Y direction (i.e., a main scanning direction perpendicular to a sheet-feed direction), so as to be reciprocated in the Y direction; a timing belt 8 disposed, for reciprocating the recording head unit 4, on an upper surface of the guide rail 3 so as to be parallel with the guide rail 3 which is disposed on a downstream side (indicated by an arrow A in FIG. 1) of the recording head unit 4 as seen in an X direction (i.e., the sheet-feed direction and a sub scanning direction); and a carriage (CR) motor 6 for driving the timing belt 8.

At one end of the recording portion 1 (on the right side in FIG. 1) that is outside a record region corresponding to the width of the paper sheet to be fed, a maintenance device 5 is disposed. The position of the maintenance device 5 corresponds to a stand-by position of the recording head unit 4. The maintenance device 5 includes a cap 7 shown in FIGS. 5A and 5B which is movable toward and away from a nozzle opening surface 22*e* of the recording head unit 4 in which nozzles 22 are formed. The maintenance device 5 may further include a wiping device for wiping the nozzle opening surface 22*e*. When the printing operation is suspended, the recording head unit 4 moves to the position corresponding to the position of the maintenance device 5 at which the nozzle opening surface 22*e* is covered with the cap 7 for preventing drying of the ink to be ejected through the nozzles 22.

Figure 2:
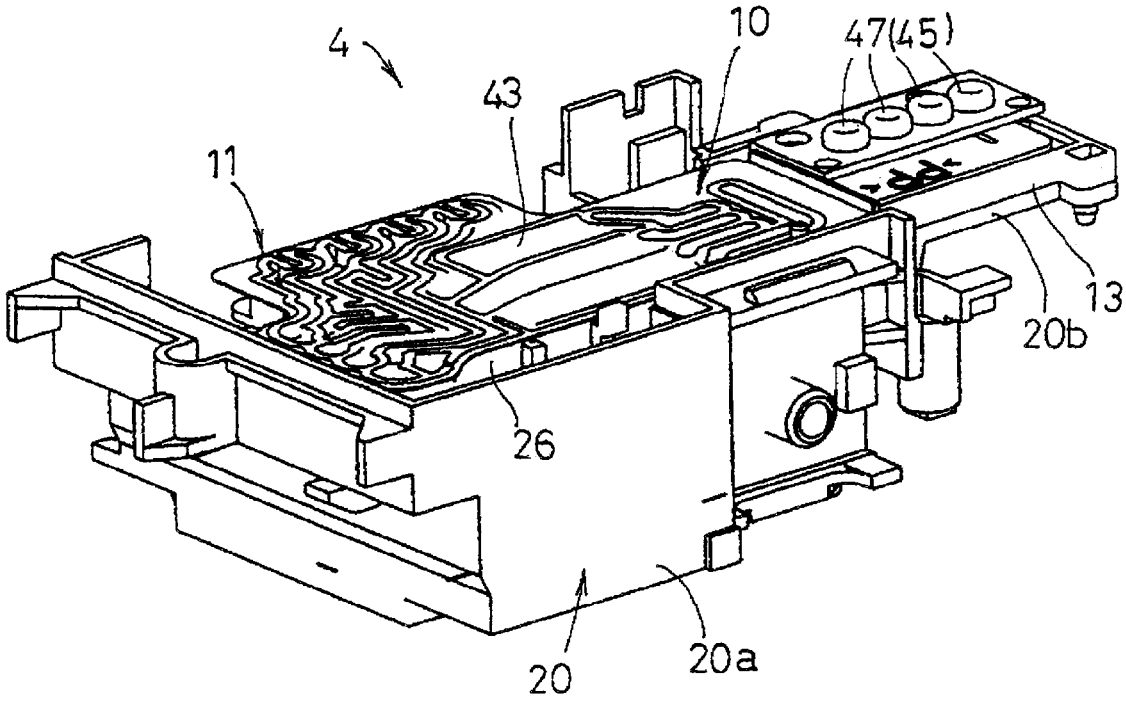
FIG. 2 is a perspective view of a recording head unit of the image recording apparatus of FIG. 1.
Figure 3:
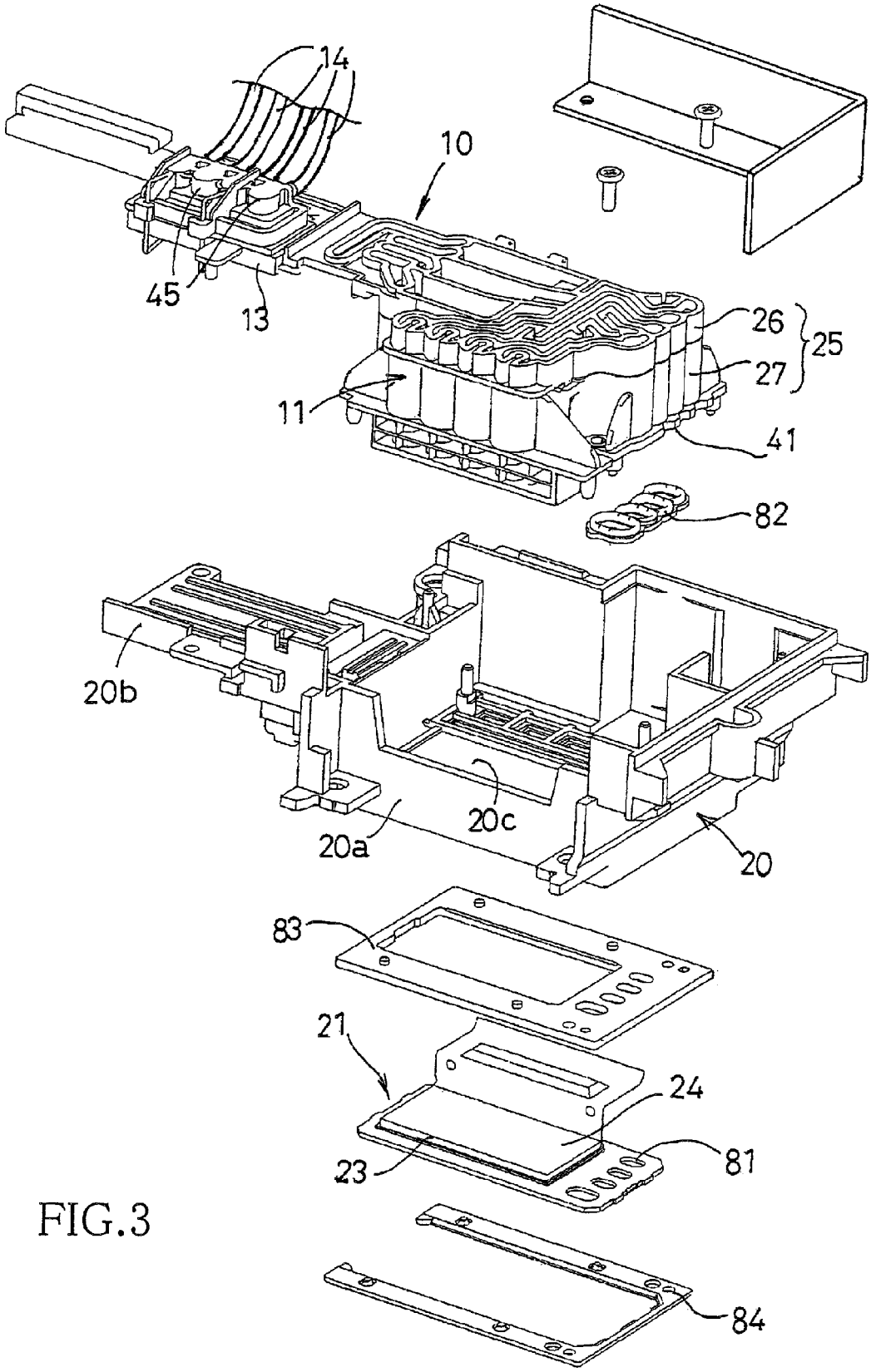
FIG. 3 is an exploded perspective view of the recording head unit of FIG. 2.
Figure 4:
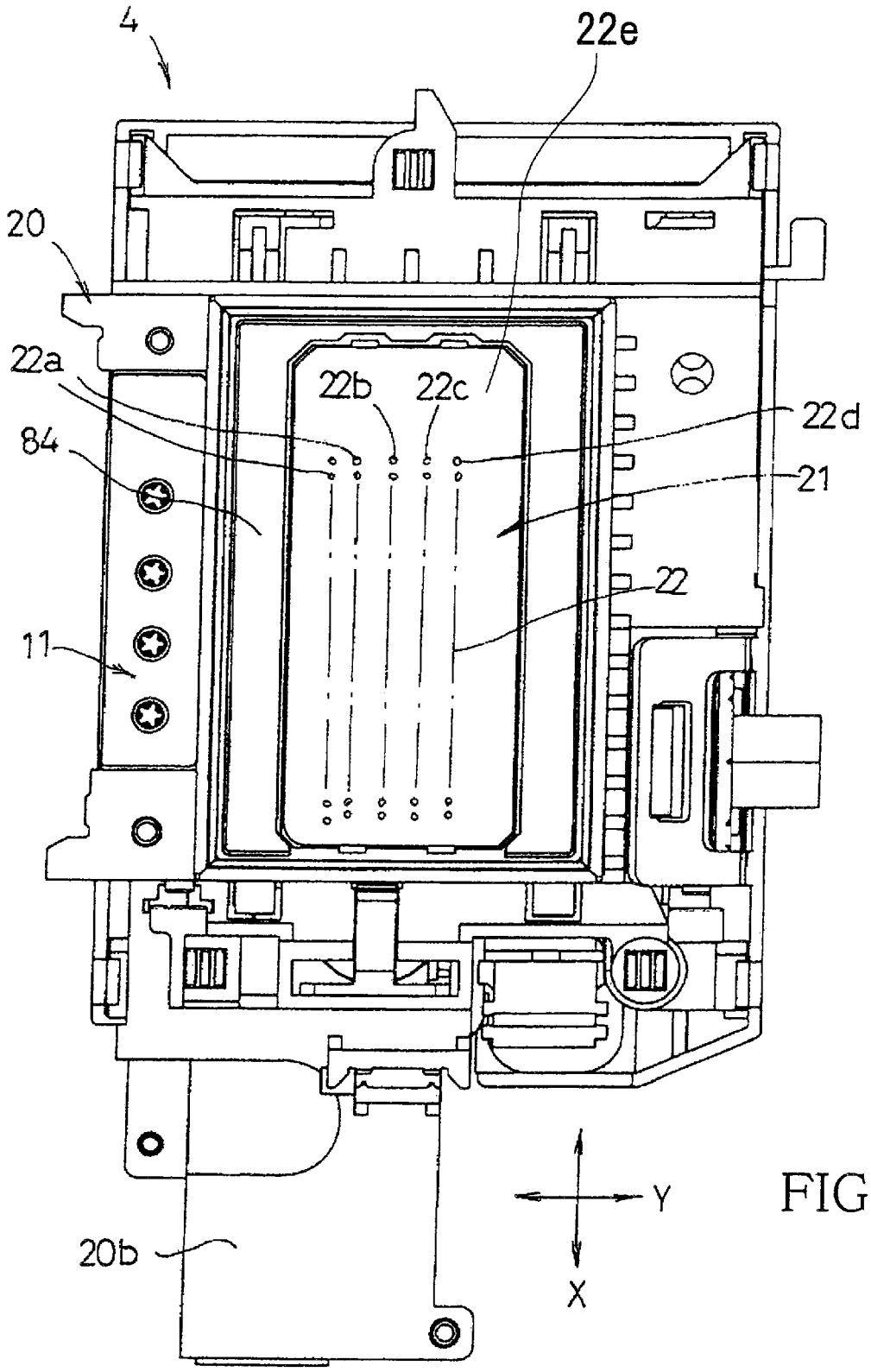
FIG. 4 is a bottom plan view of the recording head unit of FIG. 2.

As shown in FIGS. 2 and 3, the recording head unit 4 includes: a head holder 20 comprising a generally box-like main body portion 20*a*, an extending portion 20*b* that extends from the main body portion 20*a* toward a downstream side (indicated by the arrow A in FIG. 1) in the sheet-feed direction, and a bottom plate 20*c*; a recording head 21 of an ink-jet type fixedly positioned on a lower surface side of the bottom plate 20*c* of the head holder 20; and a damping device 10 and an air-discharge valve device 11 which are fixedly disposed on an upper side of the bottom plate 20*c*.

The damping device 10 has an extending portion 13 which extends substantially horizontally toward the downstream side in the sheet-feed direction (indicated by the arrow A in FIG. 1) and which is superposed on and supported by the extending portion 20*b* of the head holder 20. To the extending portion 13*a*, there are connected four ink tubes 14 at their distal ends. The image recording apparatus has, as ink supply sources, four ink tanks (not shown) respectively storing yellow ink (Y), magenta ink (M), cyan ink (C), and a black ink (BK), which are disposed within a main frame for performing full-color recording. The ink tubes 14 are connected at their proximal ends to the respective ink tanks and at their distal ends to respective ink-tube connection ports 47 of the damping device 10 via a joint member 45. In the image recording apparatus of the exemplary embodiment, the number of the inks to be used is four and accordingly the number of the ink tubes 14 is four. It is, however, noted that the kind of the ink to be used, the number of the ink tubes, etc., are not limited to those described above.

The recording head 21 has the nozzles 22 which are open in its lower surface. In the recording head unit 4, there are formed ink flow passages extending from the ink-tube connection ports 47 to the nozzles 22. The damping device 10 is provided in the route of the ink flow passages of the recording head unit 4 and is arranged to damp or absorb pressure fluctuation acting on the ink due to inertial force of the ink tubes 14 or the like, utilizing a damping effect by the air. The upper surface of the damping device 10 and the upper surface of the air-discharge valve device 11 are covered by a cover member 12 while the upper surface of the extending portion 13 is covered by a cover member 13*a*, as shown in FIG. 1.

A large number of nozzles 22 formed in the lower surface of the recording head 21 are arranged in rows, that is, two nozzle rows 22*a*, 22*a* for the black ink, one nozzle row 22*b* for the cyan ink, one nozzle row 22*c* for the yellow ink, and one nozzle row 22*d* for the magenta ink. These five nozzle rows 22*a*-22*d* are arranged in the order of description from the left side to the right side in FIG. 4 that shows the lower surface of the recording head 21. Each nozzle row extends in a direction perpendicular to a direction of the movement of the carriage (that is, in a direction perpendicular to the Y direction and the main scanning direction) and is opposed to the upper surface of the paper sheet as the recording medium. Thus, the lower surface of the recoding head 21 is formed as the nozzle opening surface 22*e* in which are the nozzles 22 are formed.

Like recording heads disclosed in U.S. Pat. No. 6,729,717 (corresponding to JP-A-2002-67312) and JP-A-2001-219560, the recording head 21 has, at one end of its upper surface, four ink supply holes 81 for respective inks of the four colors. The inks are introduced into the recording head 21 through the ink supply holes 81 and are distributed into a multiplicity of pressure chambers via ink supply channels (manifolds) extending from the ink supply holes 81. The inks are ejected from the nozzles 22 by driving an actuator 23 such as piezoelectric elements that correspond to the respective pressure chambers. As shown in FIG. 3, a flexible flat cable 24 is fixed to the upper surface of the actuator 23 for applying a voltage to the actuator 23. The recording head 21 is fixed to the lower surface of the bottom plate 20*c* of the head holder 20. For the purpose of preventing deflection of the recording head 21 when being fixed to the bottom plate 21*c*, there is interposed a reinforcing frame 83 between the recording head 21 and the bottom plate 20*c*. The head connection holes 41 (which will be described) of the damping device 10 are inserted into an opening of the bottom plate 20*c*. The ink supply holes 81 of the recording head 21 and the head connection holes 41 of the damping device 10 communicate with each other via respective openings formed in the reinforcing frame 83, with a seal member 82 such as a rubber packing interposed therebetween. Further, a generally U-shaped front frame 84 is fixed to the nozzle opening surface 22*e* (the lower surface) of the recording head 21 to avoid formation of a step in the nozzle opening surface 22*e*.

Figure 5A:
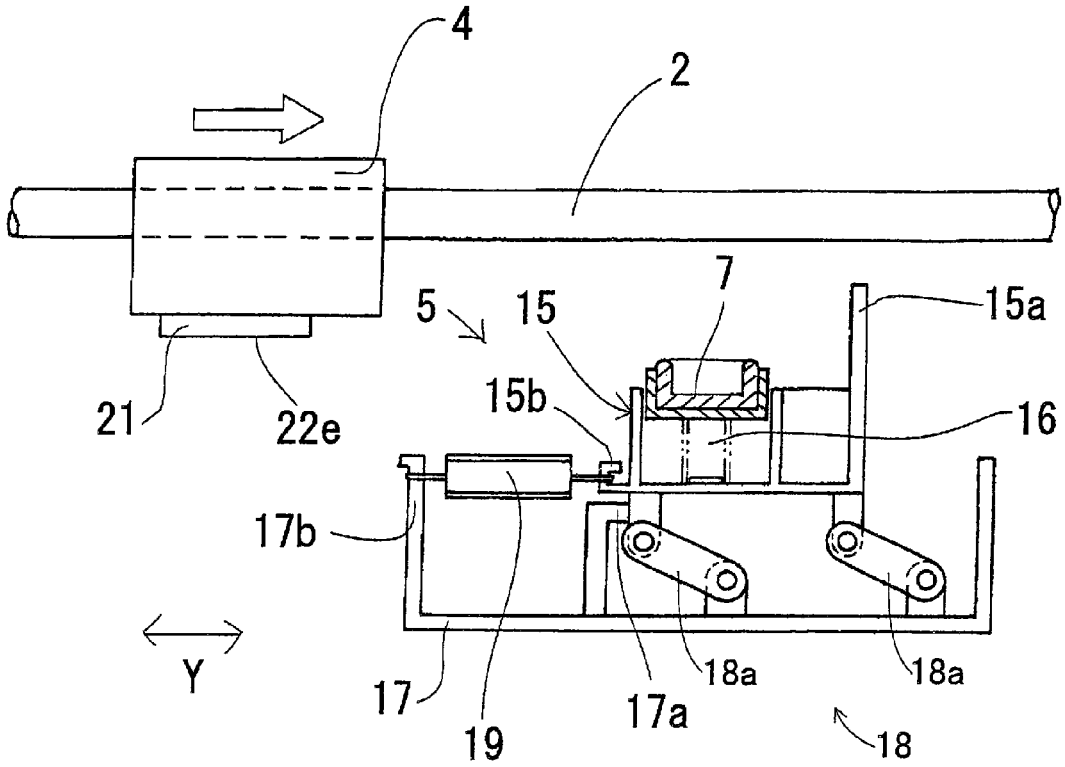
FIGS. 5A and 5B are views for explaining a movement of a cap toward and away from an ink-jet head.

There will be next explained details of the maintenance device 5. As shown in FIG. 5A, the maintenance device 5 includes: a movable support frame 15 to which the above-indicated cap 7 is mounted at an upper portion of the movable support frame 15 which is to be located adjacent to the nozzle opening surface 22*e*; and a stationary support frame 17 disposed below the movable support frame 15. The movable support frame 15 is vertically moved relative to the stationary support frame 17, whereby the cap 7 is moved toward and away from the nozzle opening surface 22*e* of the recording head 21. Between the cap 7 and the movable support frame 15, there are disposed spring like elastic members 16 for biasing the cap 7 toward the nozzle opening surface 22*e*. One 15*a* of two mutually opposing side walls of the movable support frame 15 which is more distant from the recording region has a height larger than the other of the two side walls and extends upward, i.e., toward the recording head unit 4. When the recording head unit 4 is moved to its-stand-by position corresponding to the position of the maintenance device 5, the side wall 15*a* of the maintenance device. 5 is: brought into abutting contact with a forward end face of the recording head unit 4 as viewed in its moving direction.

Between the lower surface of the movable support frame 15 and the stationary support frame 17, there is disposed a link mechanism 18 constituted by including a pair of links 18*a* disposed parallel to each other. The link mechanism. 18 joins the movable support frame 15 and the stationary support frame 17 to each other while allowing an upward and downward movement of the movable support frame 15 with respect to the stationary support frame 17 that is not accompanied by inclination of the movable support frame 15. Further, between a lower end 15*b* of the other of the two side walls of the movable support frame 15 and one 17*b* of two mutually opposing side walls of the stationary support frame 17 nearer to the recording region, there is disposed a spring-like elastic member 19 which is biased to cause the movable support frame 15 to be adjacent to the side wall 17*b*. The stationary support frame 17 has a stopper portion 17*a* on which the bottom of the movable support frame 15 is to partially abut for thereby restricting a downward movement of the movable support frame 15, so that the movable support frame 15 is prevented from being moved downward by the elastic member 19 and the link mechanism 18 by a distance larger than required.

Figure 6A:
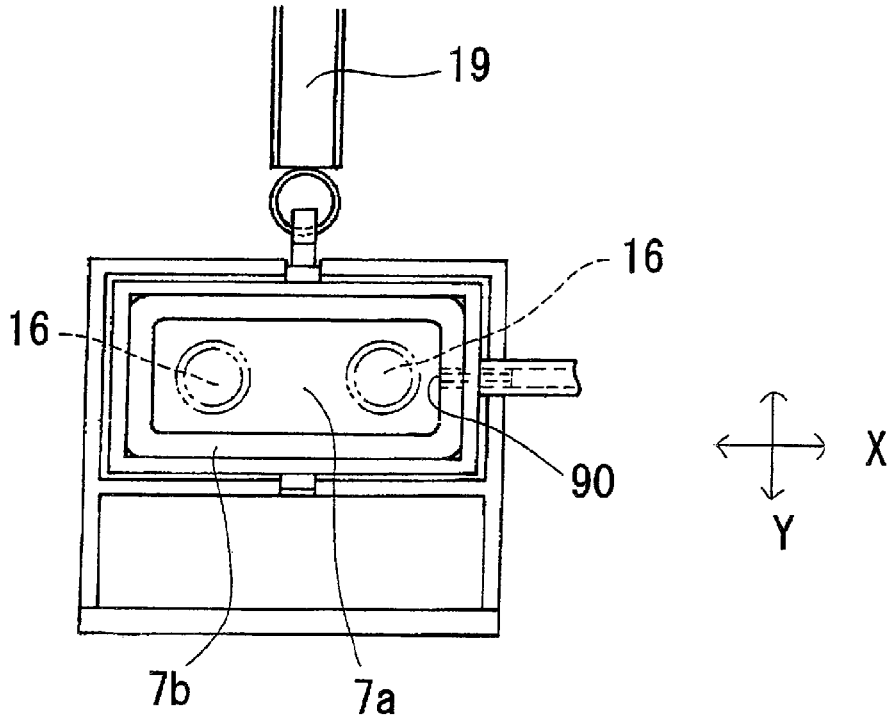
FIG. 6A is a plan view of a cap according to a first embodiment and FIG. 6B is a vertical cross sectional view showing connection between the cap and an ink absorber.
Figure 6B:
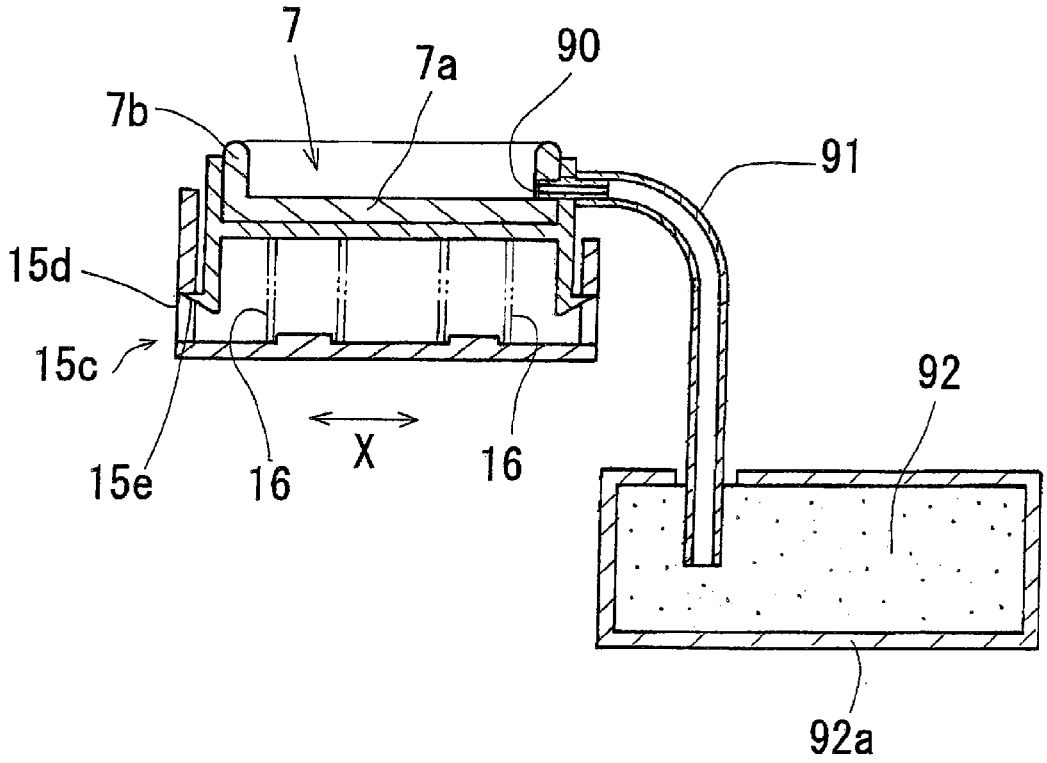

As shown in FIG. 6B, a stop mechanism 15*c* is provided between the movable support frame 15 and the cap 7 for restricting an upward movement of the cap 7, so that the cap 7 biased by the elastic members 16 is prevented from excessively pressing the nozzle opening surface 22*e*. Here, the stop mechanism 15*c* is constituted by including cutouts 15*d* formed in the movable support frame 15 and projections 15*e* formed on the cap 7. Each projection 15*e* abuts on an upper end of the corresponding cutout 15*d*, thereby restricting the upward movement of the cap 7.

The maintenance device 5 operates as follows: When the recording head unit 4 is moved to its stand-by position that corresponds to the position of the maintenance device 15 and the forward end of the recording head unit 4 abuts on the side wall 15*a* of the movable support frame 15, the movable support frame 15 is raised while being accompanied by the action of the link mechanism 18. As a result, the cap 7 is brought into abutting contact with the nozzle opening surface 22*e* while the recording head unit 4 is prevented from being moved further by the side wall 15*a* of the movable support frame 15. The cap 7 is held in close contact with the nozzle opening surface 22*e*, thereby covering the same 22*e*. In this instance, the elastic member 19 is in a stretched state.

When the recording head unit 4 is moved toward the recording region away from the maintenance device 5, the recording head unit 4 becomes apart from the side wall 15*a*, so that the elastic restoring force of the elastic member 19 acts on the movable support frame 15. As a result, the movable support frame 15 is lowered while being accompanied by the action of the link mechanism 18. The movable support frame 15 is lowered down to a position at which the movable support frame 15 abuts on the stopper portion 17*a*. Thus, the cap 7 is separated away from the nozzle opening surface 22*e*.

Figure 7A:
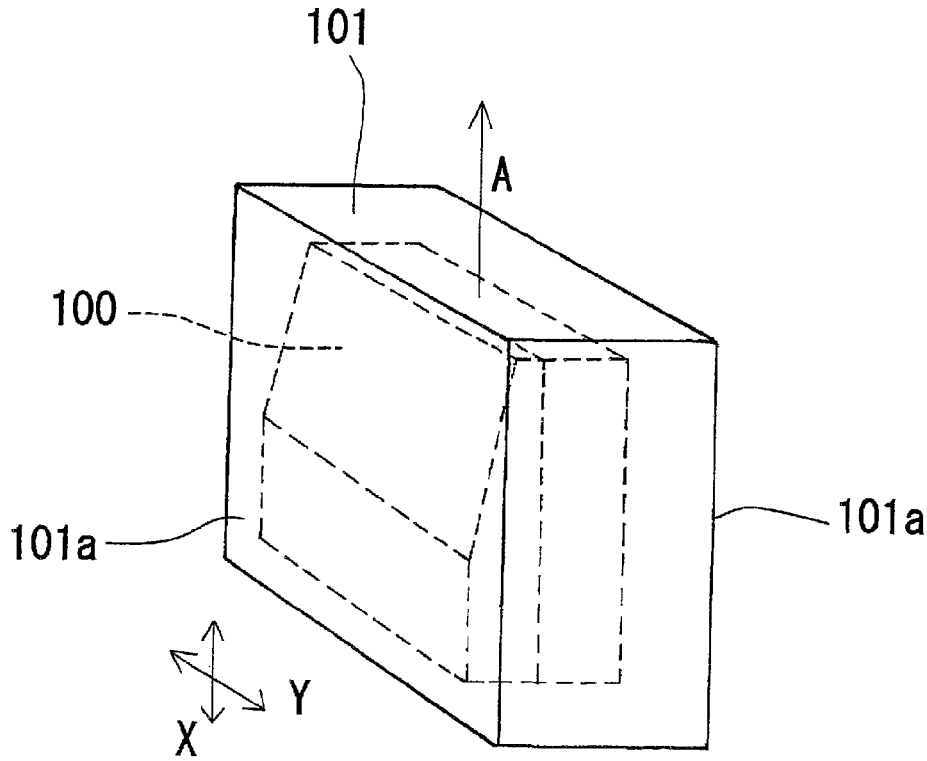
FIG. 7A is a schematic view showing the image recording apparatus packed in a package and FIG. 7B is a vertical cross sectional view showing the cap in a state in which the image recording apparatus is under transportation.

As shown in FIGS. 6A and 6B, the cap 7 includes a base portion 7*a* which is substantially parallel to the nozzle opening surface 22*e* and a peripheral portion 7*b* which extends integrally from the base portion 7*a* in a direction perpendicular to the same 7*a*. The peripheral portion 7*b* has a square shape in its plan view surrounding all of the five nozzle rows 22*a*-22*d*. According to the present invention, the cap 7 includes an outlet formed at a part thereof, which part is to be located at a lower position when the main body 100 of the image recording apparatus is kept in a posture for transportation thereof. As shown in FIG. 7A, in the exemplary embodiment, the main body 100 is accommodated in a package 101 having a substantially rectangular parallelepiped configuration in a vertical orientation in which the front of the main body 100 which is to face frontward upon use of the image recording apparatus faces upward, in other words, the main body 100 is accommodated in the package 101 such that a downstream portion of the main body 100 as viewed in the sheet-feed direction indicated by the arrow A in FIG. 1 faces upward. Accordingly, during the transportation of the main body 100, the cap 7 is kept in a posture in which the base portion 7*a* thereof vertically extends, so that the above-indicated outlet is formed, as a first outlet 90, at a part of the peripheral portion 7*b* of the cap 7, which part is located at a lower position during the transportation o the main body 100.

The first outlet 90 communicates with an ink absorber 92 via a first discharge passage 91, as shown in FIG. 6B. The ink absorber 92 is made of a material having ink absorbing property such as a porous foam resin, a felt, or a sponge, and is disposed in the main body 100 while being accommodated in a container 92*a*.

Figure 7B:
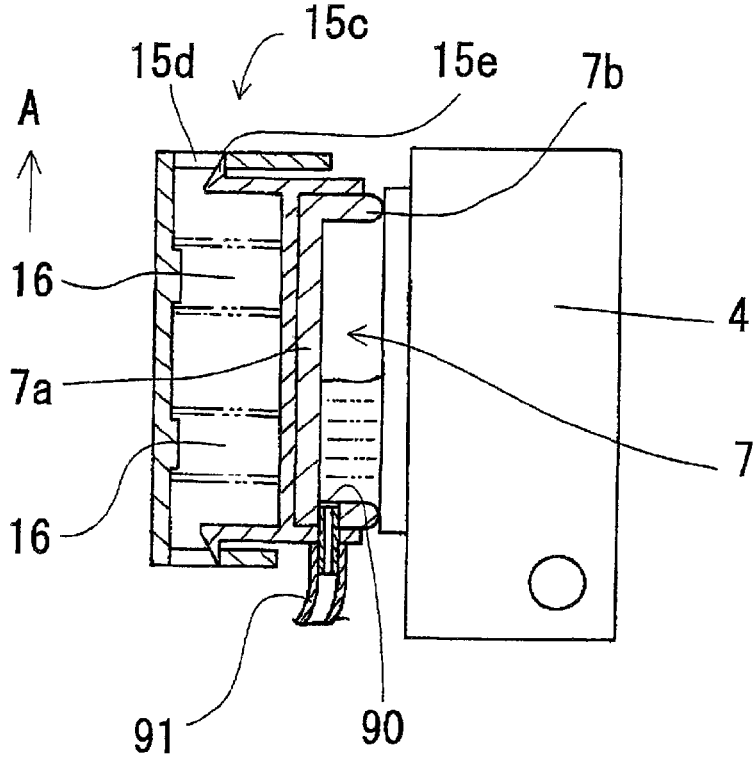

Upon shipment of the image recording apparatus, the ink channels in the recording head unit 4 are filled with the respective inks of the four colors. Further, the main body 100 of the image recording apparatus is accommodated in the package 101 in the vertical orientation with the nozzle opening surface 22*e* of the recording head unit 4 covered with the cap 7, as shown in FIG. 7A. When the air existing in the recording head unit 4 expands due to changes in the temperature or the atmospheric pressure of the environment during the transportation, the ink may leak from the nozzles 22. In the exemplary embodiment, the cap 7 is formed with the first outlet 90 at a part of its peripheral portion 7*b*, which part is located at a lower position when the main body 100 is kept in the vertical orientation shown in FIG. 7A for the transportation. Accordingly, as shown in FIG. 7B, the ink which leaks into the cap 7 readily flows out of the cap 7 through the first outlet 90 and is absorbed and retained by the ink absorber 92. Therefore, even if the amount of the ink that leaks from the nozzles 22 is relatively large, the ink does not overflow the cap 7, thereby preventing the vicinity of the recording head 21 from being contaminated with the ink. Further, because the ink does not accumulate in the cap 7, the ink does not flow back into the inside of the recording head unit 4 even when the inside of the recording head unit 4 becomes a negative pressure due to changes in the atmospheric pressure. Accordingly, where the recording head unit performs color printing as in the present embodiment, there is no risk of contamination of the inside of the recording head 21 with mixed ink.

During transportation of the image recording apparatus, it is needed to pay attention to not only changes in the temperature and the atmospheric pressure, but also changes in the humidity. Where the ink is already introduced in the recording head unit 4, there is a fear of drying and thickening of the ink to be ejected through the nozzles 22. To deal with this, the ink absorber 92 may be impregnated in advance with the ink or the storage solution to such an extent that the ink retaining property to be exhibited by the ink absorber 92 for retaining the ink discharged through the outlet 90 of the cap 7 is not deteriorated.

Figure 5B:
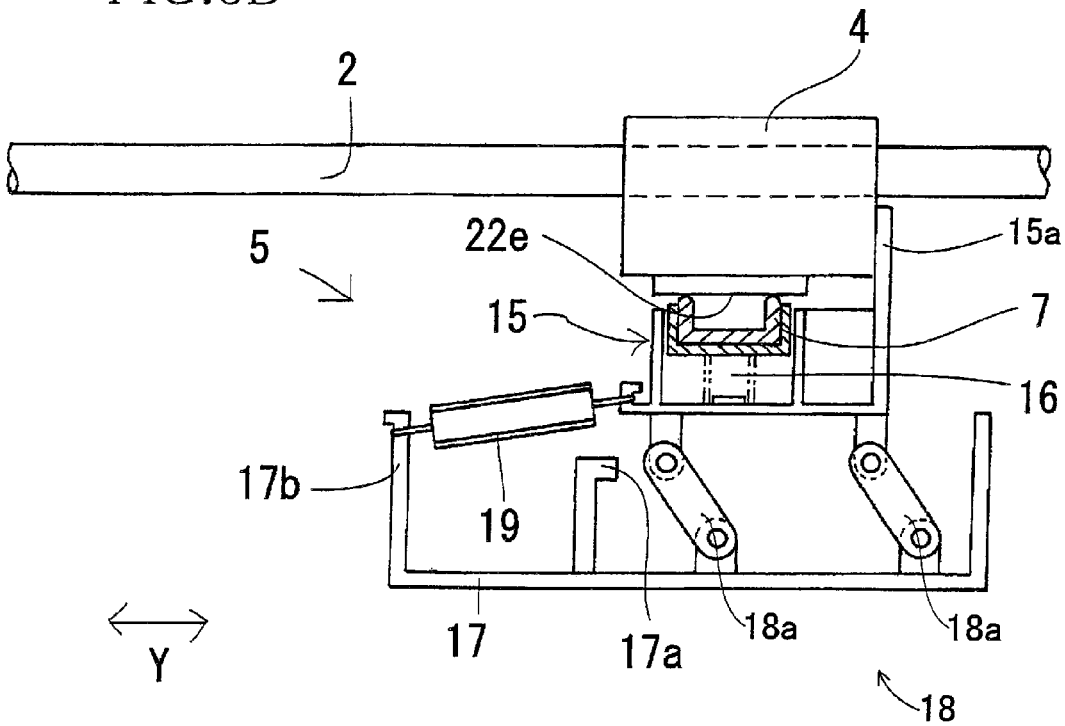

When the main body 100 taken out of the package 101 is placed, for use thereof by a user, in an appropriate posture for performing recording (i.e., in a posture in which the main scanning direction Y and the sub scanning direction X are both horizontal), the cap 7 assumes a posture in which the base portion 7*a* horizontally extends. During operation of the recording head unit 4, the cap 7 is located away from the nozzle opening surface 22*e* as shown in FIG. 5A. When the recording head unit 4 is moved to its stand-by position corresponding to the position of the maintenance device 5, the cap 7 is raised upward to cover the nozzle opening surface 22*e* as shown in FIG. 5B, thereby preventing drying of the ink to be ejected from the nozzles 22. During the operation of the recording head unit 4, the first outlet 90 of the cap 7 is kept in communication with the ink absorber 92. It may be considered, however, that the ink absorber 92 is in a state in which it absorbs and retains the ink. Accordingly, there is no fear of drying of the nozzles 22 even if the first outlet 90 is kept open in the cap 7 covering the nozzles 22. There may be provided a suitable mechanism for closing, during operation of the recording head unit 4, the first outlet 90 which has been open during the transportation of the image recording apparatus.

In the exemplary embodiment, the main body 100 is accommodated in the package 101 in the vertical orientation different from the posture when used for recording operation. The reason for this is as follows: The main body 100 has a generally rectangular parallelepiped configuration and the package 101 in which the main body 100 is accommodated also has a generally rectangular parallelepiped configuration. Accordingly, mutually opposing two surfaces each having the largest area among all surfaces of the package 101 can be utilized for advertisement. Namely, the main body 100 is accommodated in the package 101 as shown in FIG. 7A, whereby the mutually opposing two surfaces 101*a* of the package 101 each having the largest area among all surfaces of the package 100 extend in the vertical direction, permitting easy visual recognition from the exterior. Therefore, where the advertisements such as explanation of the product are indicated on those two surfaces 101*a*, for instance, it is possible to enhance the effect of advertising when transported or displayed while being accommodated in the package 101.

There will be explained a second embodiment of the invention with reference to FIGS. 8 and 9.

Figure 8A:
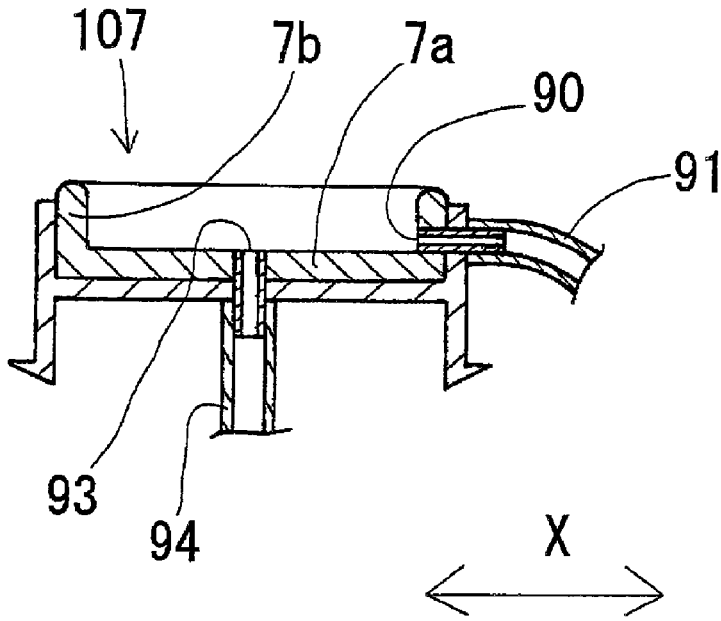
FIG. 8A is a vertical cross sectional view of a cap according to a second embodiment and FIG. 8B is a plan view of the cap.
Figure 8B:
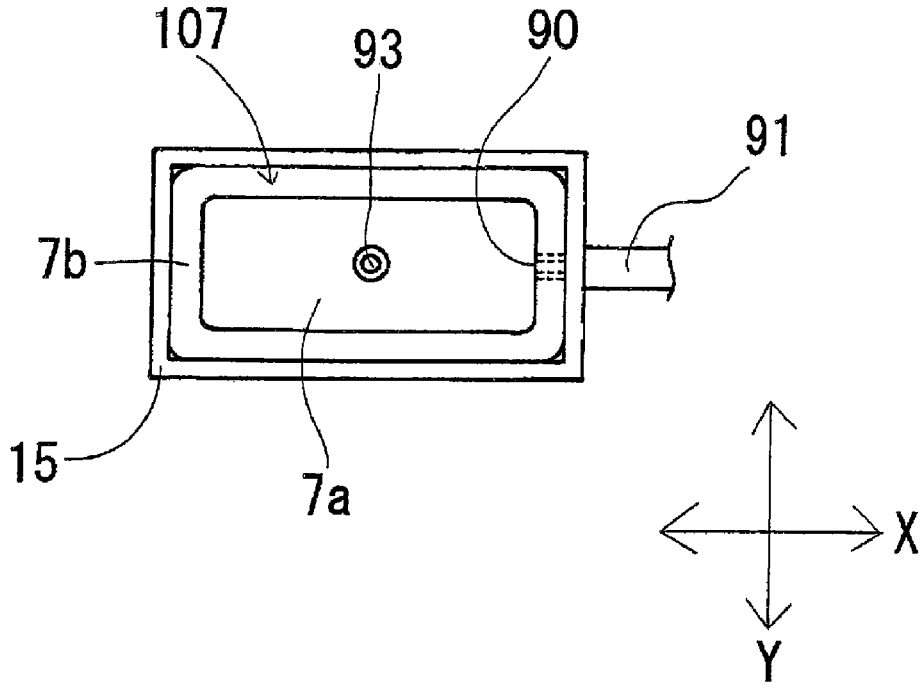

While the cap 7 in the illustrated first embodiment is provided for preventing the drying of the ink to be ejected through the nozzles 22, a cap indicated at 107 in FIGS. 8A and 8B according to the second embodiment is provided for sucking the ink from the nozzles 22 as well as preventing the drying of the ink. In the second embodiment, the same reference numerals as used in the illustrated first embodiment are used to identify the corresponding components, and a detailed explanation of which is dispensed with.

Like the cap 7 in the illustrated first embodiment, the cap 107 in the exemplary second embodiment includes a base portion 7*a* and a peripheral portion 7*b* which is formed integrally with the base portion 7*a*. The cap 107 includes a second outlet 93 which is formed in the base portion 7*a* and which communicates with a suction device 9 (shown in FIG. 9), in addition to the first outlet 90 formed at a part of the peripheral portion 7*b*, which part is to be located at a lower position during the transportation of the image recording apparatus. The suction device 9 includes a sucking pump (not shown) and is connected to the second outlet 93 via a second discharge passage 94 and a selector 95. The suction device 9 is operated for performing a restoring operation of restoring the ink ejection performance by sucking poor-quality ink (such as thickened ink or solidified ink) and air bubbles from the nozzles 22 at a predetermined timing during operation of the image recording apparatus.

Figure 9:
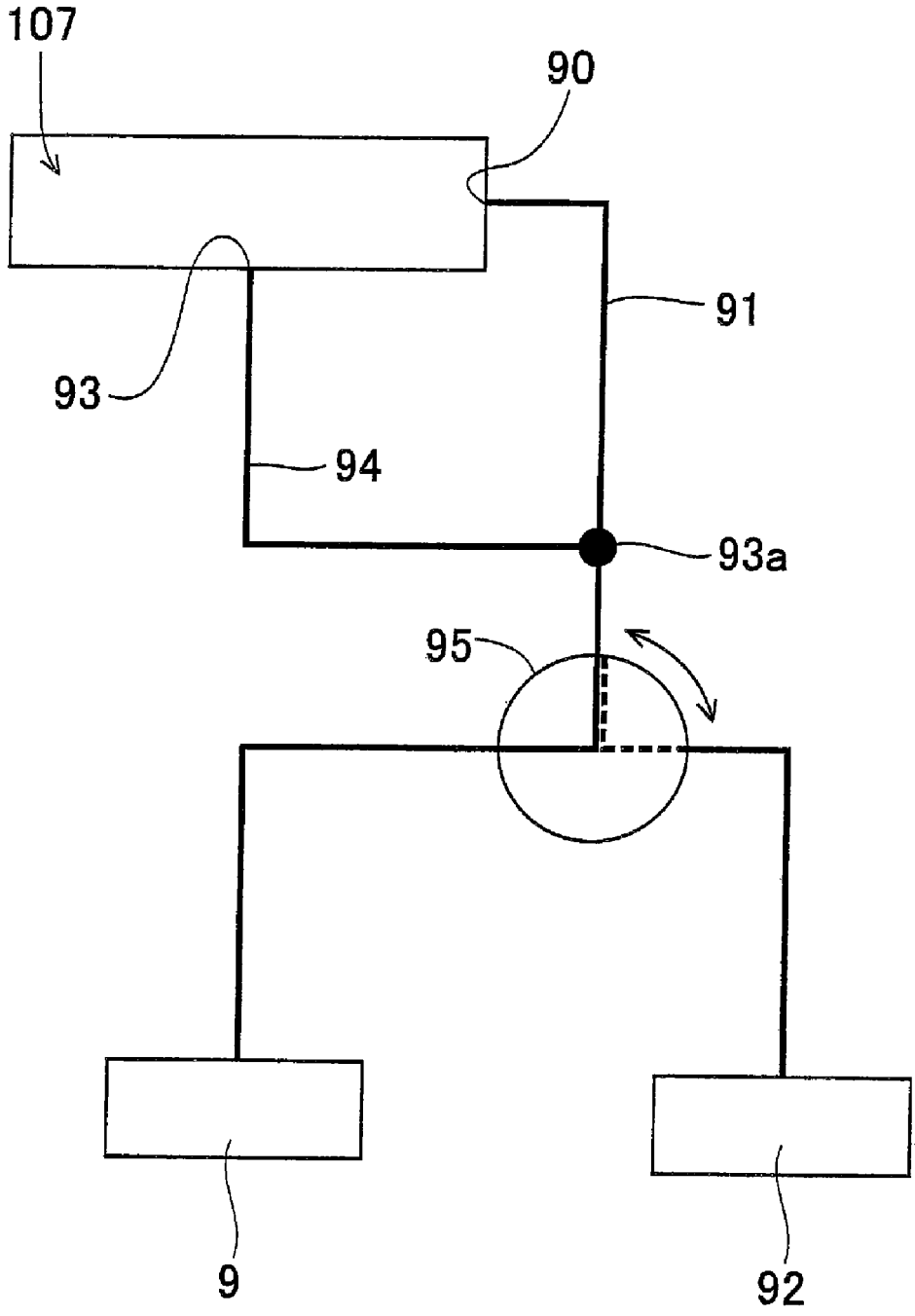
FIG. 9 is a schematic view showing connection between a first discharge passage and a second discharge passage.

As shown in FIG. 9, in the exemplary second embodiment, the second discharge passage 94 connected to the second outlet 93 and the first discharge passage 91 connected to the first outlet 90 come together or merge with each other at a confluence point 93*a*. The selector 95 is disposed between the confluence point 93*a* and the suction device 9. The selector 95 is a valve unit controlled by a controller not shown and arranged to permit the second discharge passage 94 which has merged with the first discharge passage 91 to selectively communicate with the ink absorber 92 or the suction device 9. Thus, the image recording apparatus is arranged such that the ink absorber 92 usually utilized during the use of the image recording apparatus is utilized also during the transportation of the apparatus, thereby reducing its installation space.

Like the image recording apparatus according to the illustrated first embodiment, the thus constructed image recoding apparatus according to the second embodiment is accommodated in a package 101 in a vertical orientation shown in FIG.

7A in which the front of the main body 100 of the apparatus which is to face frontward upon its use faces upward. In this state, the first outlet 90 of the cap 107 is located at a lower position. The selector 95 is designed to permit, during the transportation of the apparatus, communication between the second discharge passage 94 which merges with the first discharge passage 91 and the ink absorber 92.

In the arrangement described above, during the transportation of the image recording apparatus, the ink which has leaked into the cap 107 smoothly flows into the first discharge passage 91 through the first outlet 90, then into the second discharge passage 94 through the confluence point 93*a*, and is finally absorbed by the ink absorber 92 via the selector 95. Since the second outlet 93 also communicates with the ink absorber 92, the ink may be discharged through the second outlet 93. In the exemplary second embodiment, while the second outlet 93 is formed at the substantially central portion of the base portion 7*a* of the cap 107 as shown in FIG. 8B, the second outlet 93 may be formed in the neighborhood of the first outlet 90 for allowing easy discharge of the ink when the package 101 is vibrated or shaken during the transportation.

When the main body 100 taken out of the package 101 is placed, for use thereof by a user, in an appropriate posture for performing recording (i.e., in a posture in which the main scanning direction Y and the sub scanning direction X are both horizontal), the cap 107 assumes a posture in which the base portion 7*a* horizontally extends, so that the second outlet 93 is opposed to and located below the nozzle opening surface 22*e*. In this instance, the selector 95 is designed to permit the second discharge outlet 94 which has merged with the first discharge passage 91 to communicate with the suction device 9. According to the arrangement, the ink can be efficiently sucked and discharged from the nozzles 22 through the second outlet 93.

When the recording head unit 4 is moved toward the maintenance device 5 at a suitable timing during the operation of the image recording apparatus, the cap 107 is raised and thereby covers the nozzle opening surface 22*e* according to a mechanism similar to that in the illustrated first embodiment, as shown in FIG. 5B. Then, the suction device 9 carries out a restoring operation of restoring the ink ejecting performance by sucking the poor-quality ink and the air bubbles from the nozzles 22. Further, as needed, the selector 95 may be operated, during the operation of the apparatus, to permit the cap 107 to communicate with the ink absorber 92.

In the exemplary second embodiment, the first discharge passage 91 and the second discharge passage 94 merge with each other at the confluence point 93*a* and then are connected to the selector 95. The manner of connection is not particularly limited. For instance, the first discharge passage 91 and the second discharge passage 94 may be separately and independently connected to the selector 95 and may be separately and independently brought into communication with the ink absorber 92 and the suction device 9.

In the illustrated first and second embodiments, all of the nozzles 22 are covered with the single cap 7, 107. Where the cap 7, 107 is constructed to be divided into segments for covering the nozzles for the black ink and the nozzles for the inks of other three colors, respectively, the first and second outlets are desirably provided for each segment.

Next, the structure of the above-indicated damping device 10 will be explained. The damping device 10 described below is constructed to store, in advance, a predetermined amount of the air therein and absorb variations in the pressure of the ink, utilizing the damping effect of the air.

Figure 10A:
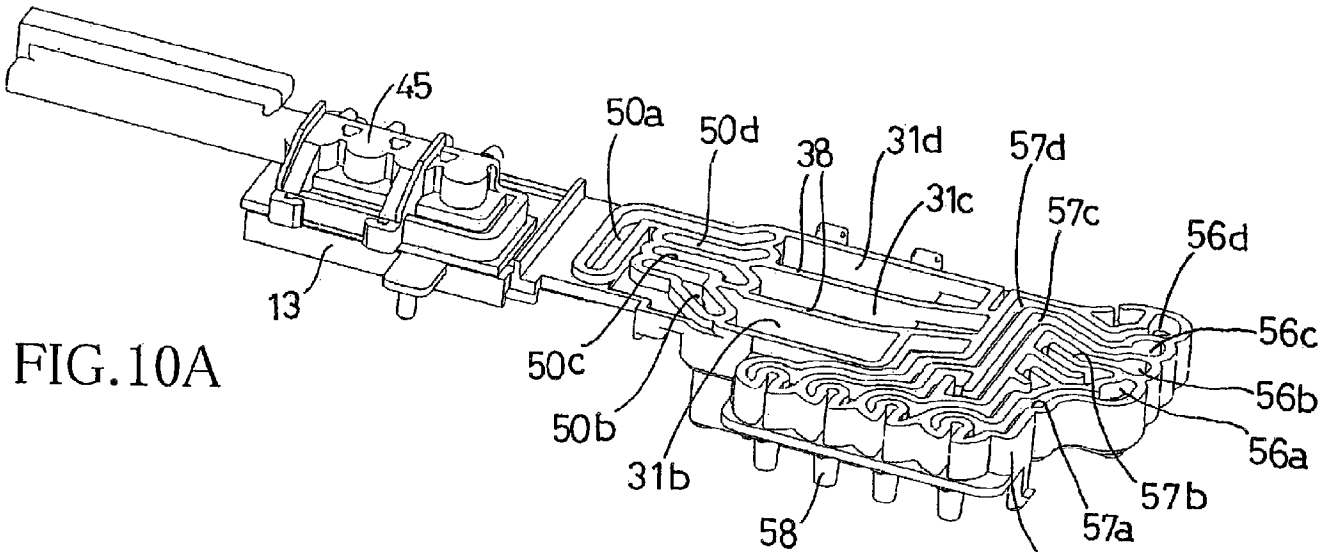
FIG. 10A is an upper perspective view of an upper casing member and FIG. 10B is an upper perspective view of a lower casing member.

As shown in FIG. 3, the damping device 10 includes a casing 25 consisting of an upper casing member 26 and a lower casing member 27 that is fixed to the upper casing member 26 such that its upper open end is covered with the upper casing member 26. The upper casing member 26 has, at one end thereof, the outwardly extending portion 13 for connection with the ink tubes 14. The damping device 10 has a main partition wall 35 and sub partition walls 36, 37 which extend in a direction intersecting the main partition wall 35. The main partition wall 35 and the sub partition walls 36, 37 cooperate with each other to define four independent ink storage chambers 30*a*-30*d* for the respective inks of the four colors. Namely, as shown in FIG. 10, there is formed, below the main partition wall 35, a damping chamber 31*a* which is a part of a black-ink storage chamber 30*a* while there are formed, above the main partition wall 35, a buffer chamber 39 which is a part of the black-ink storage chamber 30*a*, a cyan-ink storage chamber 30*b*, a yellow-ink storage chamber 30*c*, and a magenta-ink storage chamber 30*d*, thus assuming, as a whole, a two-layer structure in the vertical direction.

Figure 13:
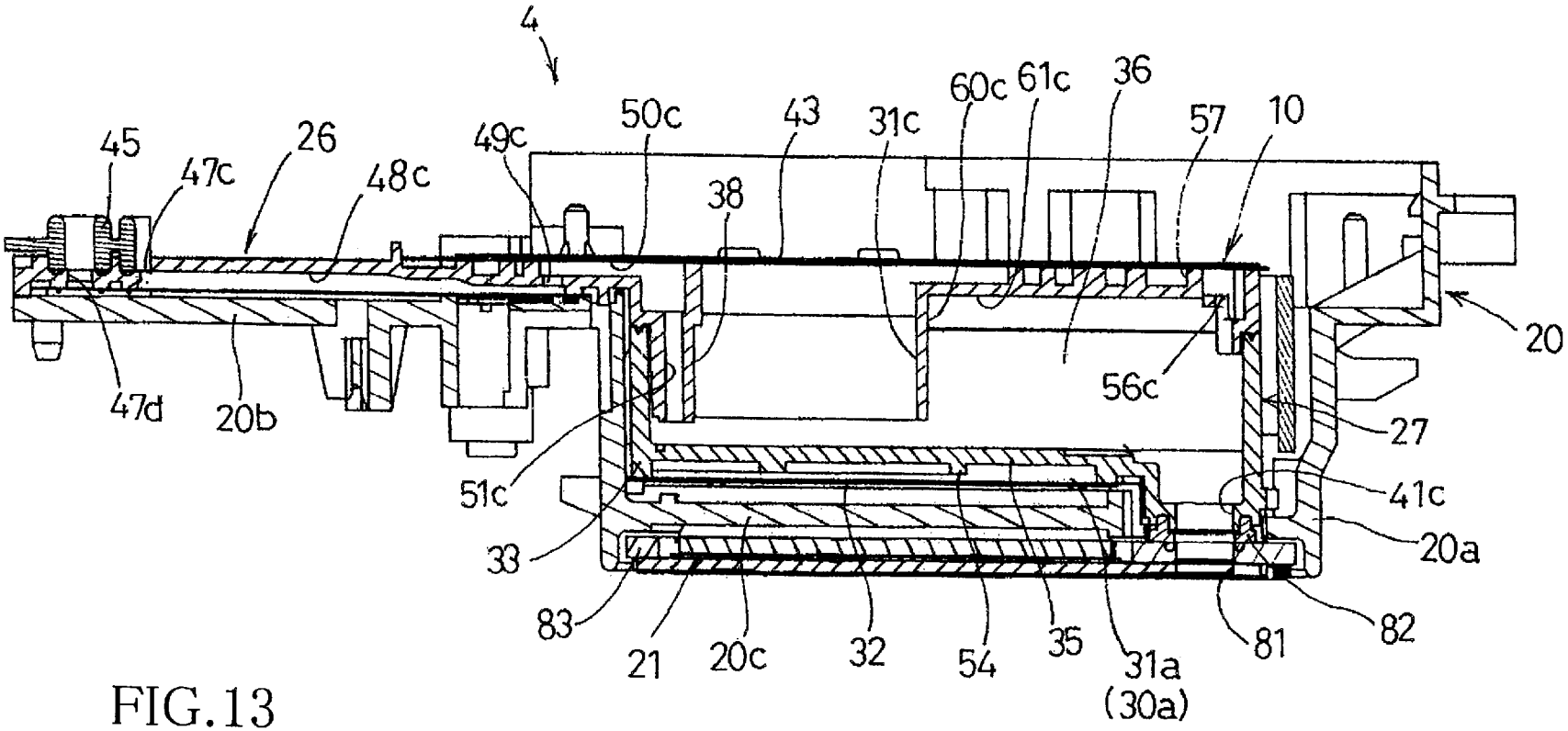
FIG. 13 is a view taken along line 13-13 in FIG. 12.

The lower casing member 27 has a lower opening at its lower surface, and the main partition wall 35 is parallel to and distant, by respective suitable distances, from the lower opening and the upper open end of the lower casing member 27, respectively. A flexible damping film 32 which is formed of a synthetic resin and which inhibits permeation of air and liquid therethrough is fixed to a lower end face a peripheral wall 33 that defines the periphery of the lower opening of the lower casing member 27, whereby the lower opening is fluid-tightly closed. According to the arrangement, the damping chamber 31*a* which has a flattened shape and which is a part of the black-ink storage chamber 30*a* is formed between the flexible damping film 32 and the main partition wall 35. The flexible damping film 32 functions a damping wall. Further, ribs 54 are formed on the lower surface of the main partition wall 35 so as to protrude therefrom into the damping chamber 31*a*, as shown in FIG. 11, whereby the ribs 54 guide the ink from an ink inlet 53*a* to an ink outlet 42. The damping device 10 is fixed to the head holder 20 such that there is formed a clearance between the flexible damping film 32 and the bottom plate 20*c* of the head holder 20 for allowing deformation of the flexible damping film 32. The four head connection holes 41*a*-41*d* of the damping device 10 connected to the respective four ink supply holes 81 of the recording head 21 are open in the lower surface of the lower casing member 27 so as to face downward and be opposed to the respective four ink supply holes 81, as shown in FIGS. 11 and 13.

On the upper surface of the main partition wall 35, the ink storage chambers 30*b*-30*d* for the cyan ink, the yellow ink, and the magenta ink, respectively, are formed and defined by the sub partition walls 36, 37 and the side wall of the lower casing member 27. These three ink storage chambers 30*b*-30*d* communicate with the corresponding head connection holes 41*b*-41*d* of the recording head 21, as shown in FIG. 13.

Figure 14:
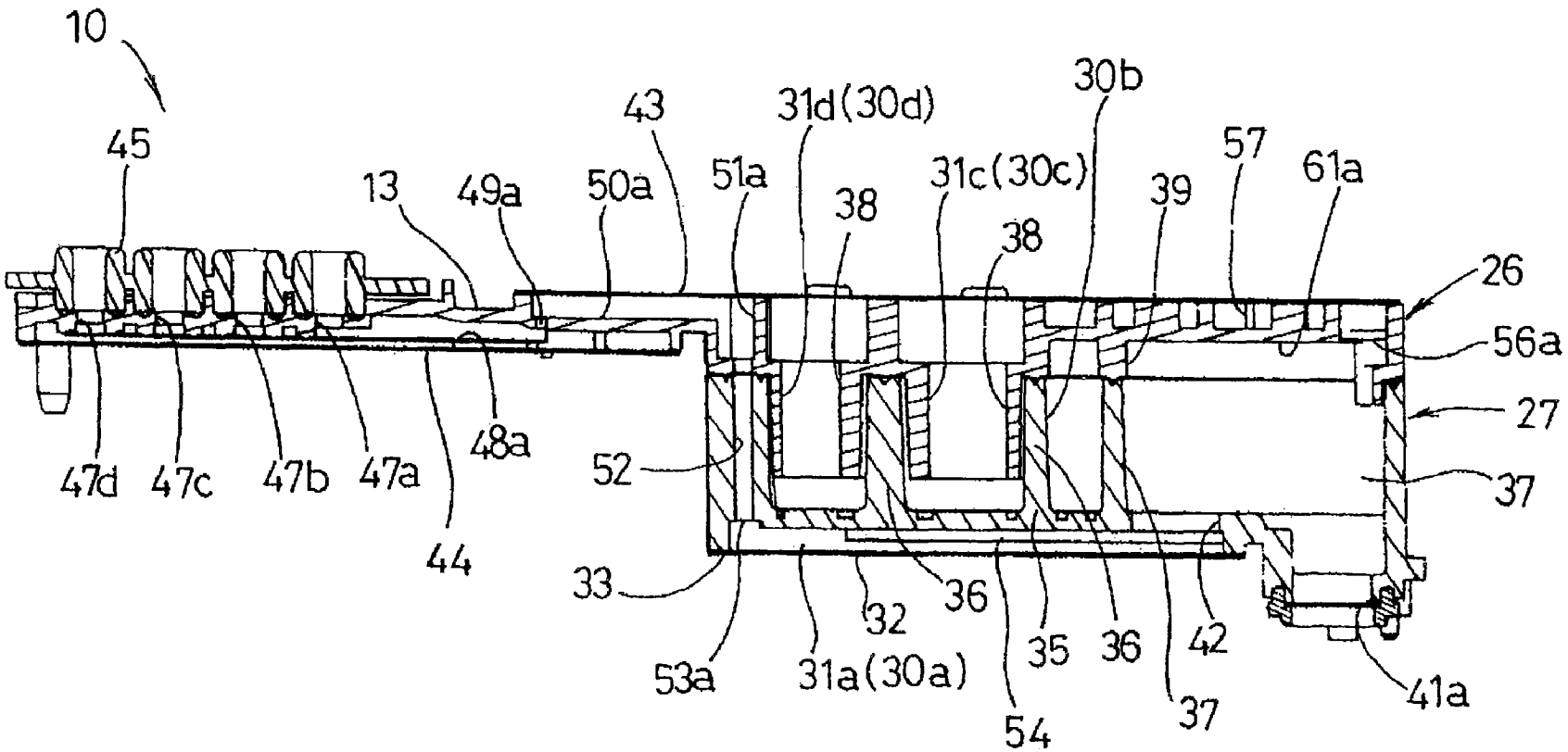
FIG. 14 is a view taken along line 14-14 in FIG. 12.

The sub partition wall 37 and the side wall of the lower casing member 27 cooperate with each other to define the buffer chamber 39 which is a part of the black-ink storage chamber 30*a* and which has a substantially triangular shape in its plan view. The black-ink storage chamber 30*a* is constituted by the damping chamber 31*a* and the buffer chamber 39 which are located below and above the main partition wall 35, respectively. The head connection hole 41*a* and the ink outlet 42 are in communication with each other through the buffer chamber 39. The buffer chamber 39 and the damping chamber 31*a* which are respectively formed below and above the main partition wall 35 are held in communication with each other via the ink outlet 42. The buffer chamber 39 is for temporarily storing the ink therein and gradually accumulating the air bubbles separated and floated from the ink on its upper side adjacent to a ceiling wall 61*a* thereof provided by the upper casing member 26. The ceiling wall 61*a* has an air-discharge hole 56*a* formed through the thickness of the upper casing member 26, as shown in FIG. 14.

As shown in FIGS. 10 and 11, the upper casing member 26 has three ribs 38 formed integrally therewith so as to protrude toward the lower casing member 27, whereby there are formed three independent regions which are surrounded by the respective three ribs 38 and each of which is open at upper and lower ends thereof. These three regions are accommodated in the corresponding three ink storage chambers 30*b*-30*d* formed in the lower casing member 27, as shown in FIG. 14. These three regions surrounded by the respective three ribs 38 respectively function damping chambers 31*b*-31*d* for accumulating, prior to use of the apparatus, a predetermined amount of the air bubbles within the respective ink storage chambers 30*b*-30*d*. The air bubbles accumulated in the damping chambers 31*b*-31*d* are surrounded by the ribs 38, so that the air bubbles continue to be accumulated with high reliability to a predetermined amount which is defined by the length of extension of the ribs 38 into the lower casing member 27, without being discharged through the air-discharge holes 56*b*-56*d*. The upper open ends of the respective three damping chambers 31*b*-31*d* are commonly closed by a flexible damping film 43 which is formed of a synthetic resin and inhibits permeation of air or liquid therethrough. The flexible damping film 43 is fixed by an adhesive or ultrasonic welding, to upper end faces of peripheral walls which define the respective three damping chambers 31*b*-31*d*.

In each of the ink storage chambers 30*b*-30*d*, downstream regions of the respective damping chambers 31*b*-31*d* located nearer to the corresponding head connection holes 41*b*-41*d* are respectively made as air-bubble trap chambers 60*b*-60*d* in which the air bubbles separated and floated from the ink are gradually accumulated. In ceiling walls 61*b*-61*d* of the respective damping chambers 31*b*-31*d* provided by the upper casing member 26, the air-discharge holes 56*b*-56*d* are formed through the thickness of the respective ceiling walls 61*b*-61*d*.

To the respective ink-tube connection ports 47 formed in the extending portion 13 of the upper casing member 26, the ink tubes 14 are respectively connected via the joint member 45 having ink flow passages for the respective inks of the four colors. In the upper casing member 26, there are formed: first recessed passages 48*a*-48*d* which are open to the lower surface of the upper casing member 26 so as to face downward: first communication holes 49*a*-49*d* each of which is formed at one end of the corresponding first recessed passage 48*a*-48*d* through the thickness of the upper casing member 26; second recessed passages 50*a*-50*d* each of which is connected at one end thereof to the corresponding communication hole 49*a*-49*d* and which are open to the upper surface of the upper casing ember 26 so as to face upward; and second communication holes 51*a*-51*d* each of which is formed at another end of the corresponding second recessed passage 50*a*-50*d* through the thickness of the upper casing member 26. As for the black ink, a third communication hole 52 which is formed through the lower casing member 27 and which is open to the lower surface of the main partition wall 35 communicates with the second communication hole 51*a*, and one end of the third communication hole 52 is made as the ink inlet 53*a* through which the black ink flows into the damping chamber 31*a*. As for the inks of the other three colors, i.e., cyan, magenta, and yellow, the second communication holes 51*b*-51*d* are formed integrally with the respective ribs 38, and lower open ends of the respective second communication holes 51*b*-51*d* are made as the ink inlets 53*b*-53*d* through which the cyan ink, the magenta ink, and the yellow ink flow into the respective ink storage chambers 30*b*-30*d*.

The air-discharge hole 56*a* which communicates with the buffer chamber 39 and the air-discharge holes 56*b*-56*d* which communicate with the respective air-bubble trap chambers 60*b*-60*d* are connected at their upper ends to respective air-discharge passages 57*a*-57*d* each of which is in the form of a recess formed in the upper surface of the upper casing member 26, so as to be connected to the air-discharge valve unit 11.

The first recessed passages 48*a*-48*d* formed in the lower surface of the extending portion 13 of the upper casing member 26 are commonly covered by a film 44 that is fixed to lower ends of respective peripheral walls which define the respective first recessed passages 48*a*-48*d*, whereby the first recessed passages 48*a*-48*d* serve as ink flow passages. The second recessed passages 50*a*-50*d* and the air-discharge passages 57*a*-57*d* are commonly covered by an extended portion of the flexible damping film 43, whereby those passages serve as the ink flow passages.

Figure 10B:
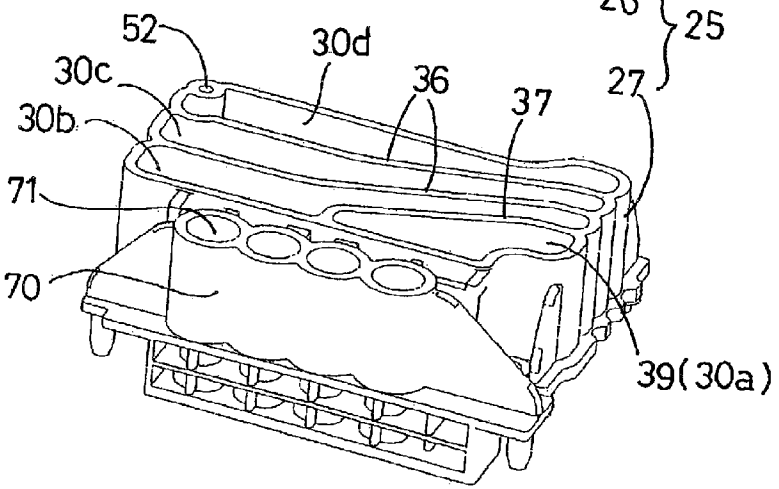
Figure 11A:
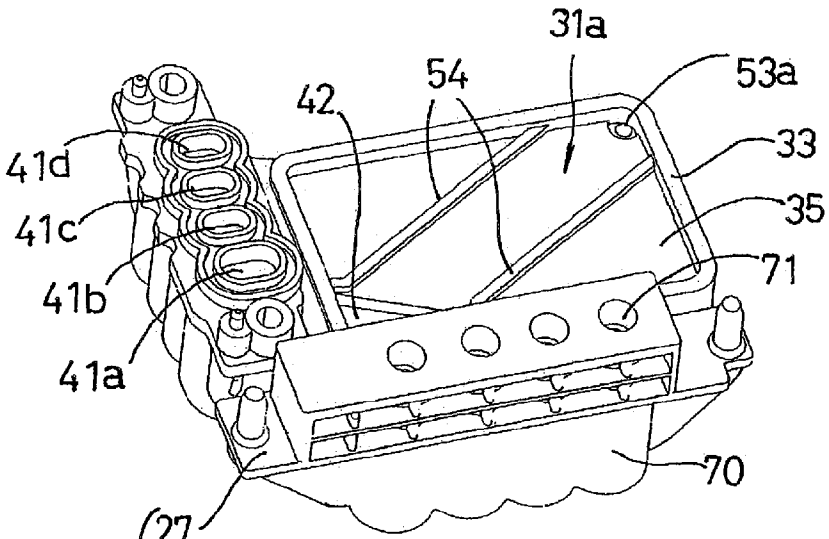
FIG. 11A is a lower perspective view of the lower casing member and FIG. 11B is a lower perspective view of the upper casing member.
Figure 11B:
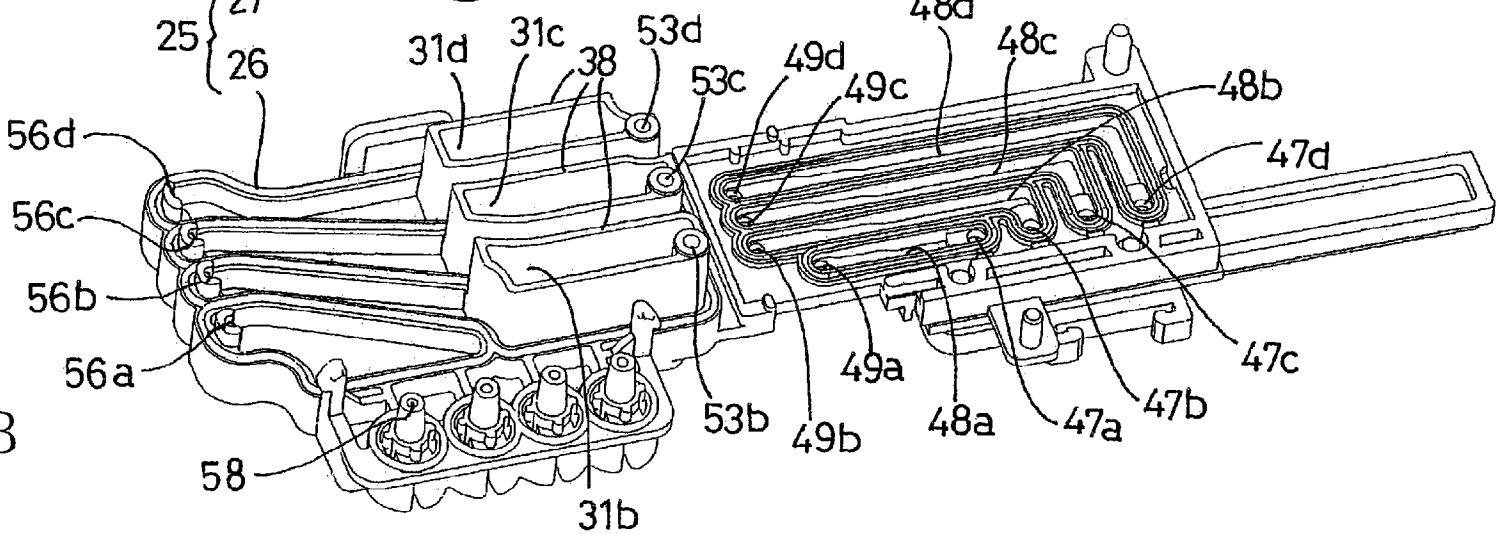
Figure 12:
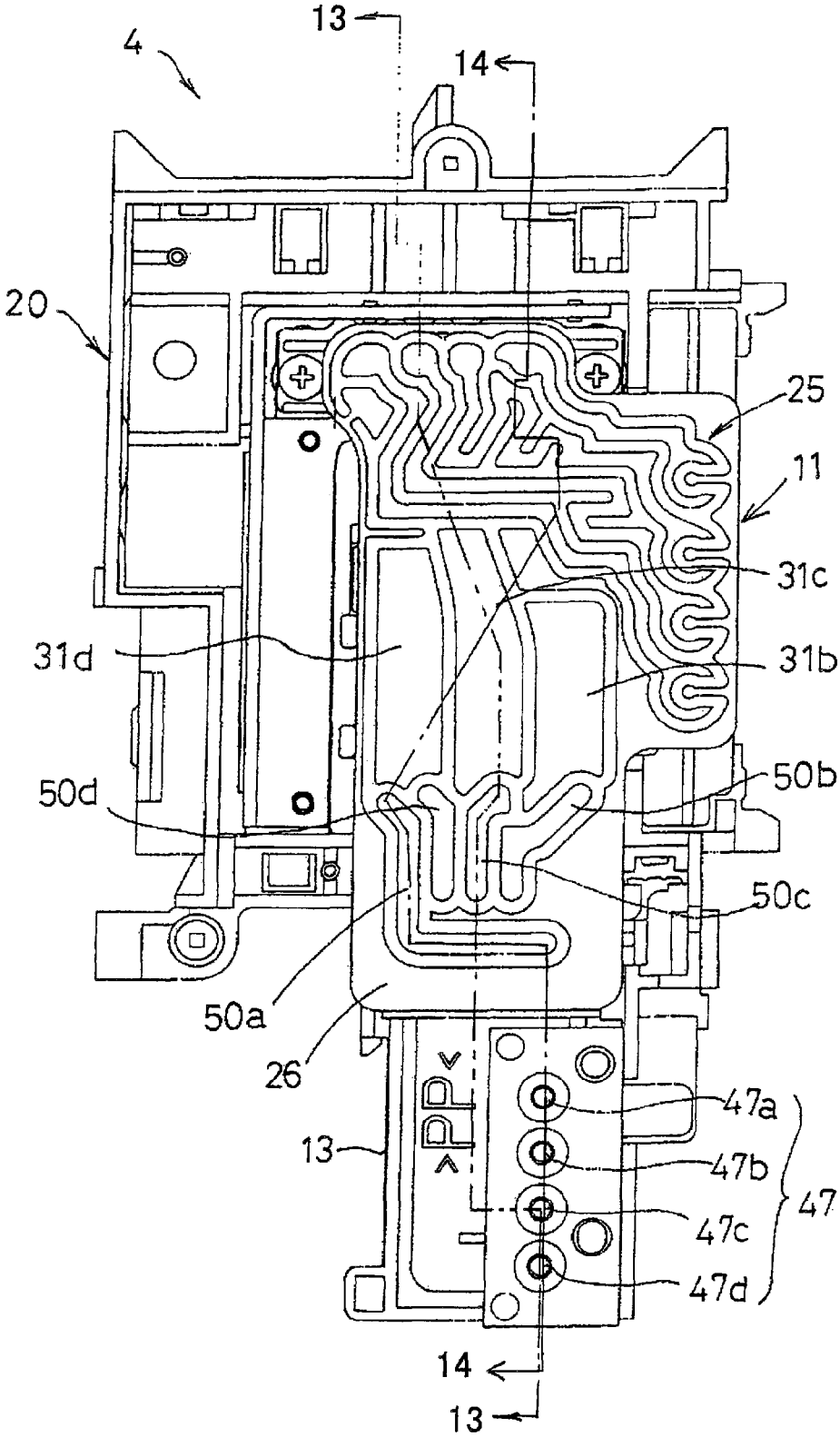
FIG. 12 is a plan view of the recording head unit in the absence of a flexible film of a damping device to be provided to cover an upper surface of the unit.

As shown in FIGS. 10B and 11A, the air-discharge valve unit 11 has an accommodating portion 70 which is provided integrally with one side portion of the lower casing member 27. The accommodating portion 70 has four passages holes 71 for the respective inks of the four colors. Each of the passage holes 71 extends in the vertical direction and is open at its upper and lower ends. One side edge of the upper casing member 26 is extended to a location corresponding to the upper end of the accommodating portion 70, and open end portions 58 of the respective air-discharge passages 57*a*-57*d* communicate with the upper ends of the respective passage holes 71. Within each of the passage holes 71, there is accommodated a valve member not shown which is driven to open and close the lower open end of the passage hole 71. When the carriage is moved to the position in the ink-jet printer corresponding to the maintenance device, the vale members are driven so as to open the lower open ends of the respective passage holes 71, whereby the air is sucked by a suction pump through the lower open ends. Thus, the air bubbles in the ink-storage chambers 30*a*-30*d* can be discharged through the air-discharge holes 56*a*-56*d* and the air-discharge passages 57*a*-57*d*.

In the structure described above, the black ink which has flowed into the damping chamber 31*a* through the ink inlet 53*a* is received directly by the flexible film 32 as the damping wall, so that the dynamic pressure of the ink can be absorbed with high reliability by a wide area of the damping wall. The black ink, together with the air bubbles contained therein, is guided by the ribs 54 extending downward from the upper wall of the damping chamber 31, toward the ink outlet 42. Thus, the black ink is smoothly discharged through the ink outlet 42.

The black ink which has flowed out of the damping chamber 31 through the ink outlet 42 then flows, together with the air bubbles, into the buffer chamber 39 formed above the main partition wall 35. In the buffer chamber 39, the ink to be supplied to the recording head 21 is temporarily stored, and the air bubbles separated and floated from the ink are gradually accumulated at its upper portion adjacent to the ceiling wall 61*a*. Then, the black ink is supplied to the black-ink ink supply hole 81 of the recording head 21 through the corresponding head connection port 41*a* formed at the bottom of the buffer chamber 39.

In the meantime, the cyan ink, the yellow ink, and the magenta ink flow into the respective ink storage chambers 30*b*-30*d* through the respective ink inlets 53*b*-53*d*. The ink storage chambers 30*b*-30*d* have the respective damping chambers 31*b*-31*d* each of which is located on an upstream portion thereof, in which a predetermined amount of the air bubbles is stored beforehand, and whose upper walls are defined by the flexible film 43. Accordingly, the dynamic pressure of the inks flowed into the respective ink storage chambers 30*b*-30*d* are absorbed or damped by a cooperative action of the air bubbles and the flexible film 43. The air bubbles separated and floated from the inks in the respective ink storage chambers 30*b*-30*d* are gradually accumulated in the respective air-bubble trap chambers 60*b*-60*d*.

When the air-discharge valve unit 11 is connected to the suction pump, the air bubbles accumulated in the buffer chamber 39 and the air-bubble trap chambers 60*b*-60*d* are discharged to the exterior through the respective air-discharge holes 56*a*-56*d*, the respective air-discharge passages 57*a*-57*d*, and the air-discharge valve unit 11.

Where the damping device 10 is constituted as an air damper for storing, in advance, a predetermined amount of the air, the air within the damping device 10 is likely to expand and contract due to changes in the temperature and the pressure during transportation of the image recording apparatus, giving rise to a major cause of ink leakage. In the image recording apparatus according to the present invention, however, owing to the cap 7 constructed according to the illustrated first embodiment and the cap 107 constructed according to the illustrated second embodiment, the ink can be smoothly discharged toward the ink absorber 92 even if a large amount of the ink leaks into the cap 7, 107 due to expansion of the air. Therefore, the present invention is suitably applicable to the image recording apparatus equipped with the air damper described above.

Unlike the damping device 10, the recording head 4 is not arranged to store a predetermined amount of the air therein. Nevertheless, the air somewhat flows into the ink flow passages within the recording head unit 4 when the recording head unit 4 is disconnected from the ink supply sources or the ink tubes. In this instance, the air may expand due to changes in the atmospheric pressure, resulting in the ink leakage phenomenon. Accordingly, the principle of the present invention is applicable to an image recording apparatus whose recording head unit is not equipped with the above-indicated damping device as the air damper.

The illustrated embodiments are explained for a case in which the image recording apparatus is shipped with the ink introduced in the recording head unit 4. In place of the ink, the storage solution may be introduced in the recording head unit 4.

While the preferred embodiments of the present invention have been described above, it is to be understood that the invention is not limited to the details of the illustrated embodiments, but may be embodied with various other changes and modifications, which may occur to those skilled in the art, without departing from the spirit and scope of the invention.

What is claimed is:

1. An image recording apparatus comprising:

an ink-jet head having a plurality of nozzles which are open in a surface thereof so as to provide a nozzle opening surface and through which ink is ejected;

a cap which is operable to cover the nozzle opening surface of the ink-jet head so as to surround the plurality of nozzles and which includes (a) a peripheral portion that comes into close contact with the nozzle opening surface at an end thereof when the cap covers the nozzle opening surface and (b) an outlet formed at a part of the peripheral portion, the part being located at a lower position when the image recording apparatus is kept in a posture for transportation thereof; and an ink absorbing device which is disposed outside of and separately from the cap and which comprises an ink absorber that communicates with the outlet via a discharge passage and a container that accommodates the ink absorber therein, wherein the container is configured to prevent ink absorbed by the ink absorber from leaking out of the container at least when the image recording apparatus is in a first position and when the image recording apparatus is in a second position, wherein in the first position, the nozzle opening surface is substantially aligned with a horizontal plane, and wherein in the second position, the nozzle opening surface is substantially aligned with a vertical plane.

2. The image recording apparatus according to claim 1, wherein the nozzle opening surface of the ink-jet head is generally vertical when the image recording apparatus is kept in the posture for transportation thereof.

3. The image recording apparatus according to claim 1, wherein the cap includes a base portion that extends generally parallel to the nozzle opening surface of the ink-jet head when the cap covers the nozzle opening surface, and wherein the peripheral portion of the cap is formed integrally with the base portion so as to extend in a direction intersecting the base portion.

4. The image recording apparatus according to claim 1, wherein the cap is operable to move toward and away from the nozzle surface of the ink-jet head and the cap covers the nozzle opening surface when the cap is moved toward the nozzle opening surface.

5. The image recording apparatus according to claim 1, wherein the image recording apparatus is accommodated, during transportation thereof, in a package which has a generally rectangular parallelepiped configuration, and wherein the package in which the image recording apparatus is accommodated is placed such that mutually opposing two surfaces each having the largest area in all surfaces of the package are vertical during the transportation of the image recording apparatus.

6. An image recording apparatus comprising:

an ink-jet head having a plurality of nozzles which are open in a surface thereof so as to provide a nozzle opening surface and through which ink is ejected; and a cap which is operable to cover the nozzle opening surface of the ink-jet head so as to surround the plurality of nozzles and which includes (a) a peripheral portion that comes into close contact with the nozzle opening surface at an end thereof when the cap covers the nozzle opening surface and (b) an outlet formed at a part of the peripheral portion, the part being located at a lower position when the image recording apparatus is kept in a posture for transportation thereof, wherein the cap includes, in addition to the outlet as a first outlet, another outlet as a second outlet that is formed at a part thereof, the part being located at a lower position when the image recording apparatus is kept in a posture for use thereof.

7. The image recording apparatus according to claim 6, wherein the nozzle opening surface of the ink-jet head is generally vertical when the image recording apparatus is kept in the posture for transportation thereof while the nozzle opening surface is generally horizontal when the image recording apparatus is kept in the posture for use thereof.

8. The image recording apparatus according to claim 6, wherein the cap includes a base portion that extends generally parallel to the nozzle opening surface of the ink-jet head when the cap covers the nozzle opening surface, wherein the peripheral portion of the cap is formed integrally with the base portion so as to extend in a direction intersecting the base portion, and wherein the second outlet is formed in the base portion.

9. The image recording apparatus according to claim 6, further comprising an ink absorber and arranged such that both of the first outlet and the second outlet are to communicate with the ink absorber.

10. The image recording apparatus according to claim 6, further comprising a suction device for sucking ink from the plurality of nozzles and arranged such that the second outlet is to communicate with the suction unit.

11. The image recording apparatus according to claim 10, further comprising:

an ink absorber; and a selector which selects one of: a state in which the first outlet and the second outlet communicate with the ink absorber; and a state in which at least the second outlet communicates with the suction device.

12. The image recording apparatus according to claim 11, further comprising a first discharge passage and a second discharge passage which are connected respectively to the first outlet and the second outlet and which come together at a confluence point, and wherein the selector is arranged to select one of: a state in which the confluence point communicates with the ink absorber; and a state in which the confluence point communicates with the suction device.

* * * * *